US009217329B1

(12) United States Patent
Richey

(10) Patent No.: US 9,217,329 B1
(45) Date of Patent: Dec. 22, 2015

(54) COMPRESSED AIR PROPULSION SYSTEM

(71) Applicant: Robert John Richey, Campbell, CA (US)

(72) Inventor: Robert John Richey, Campbell, CA (US)

( * ) Notice: Subject to any disclaimer, the term of this patent is extended or adjusted under 35 U.S.C. 154(b) by 0 days.

(21) Appl. No.: 14/756,548

(22) Filed: Sep. 16, 2015

Related U.S. Application Data

(63) Continuation-in-part of application No. 14/256,754, filed on Apr. 18, 2014, now abandoned.

(51) Int. Cl.

| | |
|---|---|
| ***F16D 31/02*** | (2006.01) |
| ***F01B 7/14*** | (2006.01) |
| ***F01B 11/00*** | (2006.01) |
| ***F01B 25/04*** | (2006.01) |
| ***F01B 29/10*** | (2006.01) |
| ***F01L 31/16*** | (2006.01) |

(52) U.S. Cl.
CPC ..... *F01B 7/14* (2013.01); *F01B 11/001* (2013.01); *F01B 25/04* (2013.01); *F01B 29/10* (2013.01); *F01L 31/16* (2013.01)

(58) Field of Classification Search
CPC ..... F01B 7/14; F01B 11/001; F01B 25/04; F01B 25/14; F01B 29/10; F01L 31/16
USPC ..... 60/370, 408, 409
See application file for complete search history.

(56) References Cited

U.S. PATENT DOCUMENTS

| | | | | |
|---|---|---|---|---|
| 3,485,221 | A * | 12/1969 | Feeback | F01B 7/14 123/51 AA |
| 3,980,152 | A * | 9/1976 | Manor | B60G 13/14 180/165 |
| 4,370,857 | A * | 2/1983 | Miller | B60K 3/02 180/165 |
| 4,560,323 | A | 12/1985 | Orchard | |
| 5,515,675 | A * | 5/1996 | Bindschatel | F02B 69/06 60/370 |
| 6,629,573 | B1 * | 10/2003 | Perry | F01B 17/02 180/165 |
| 7,028,482 | B2 * | 4/2006 | Cho | B60K 1/00 60/407 |
| 7,315,089 | B2 * | 1/2008 | Lambertson | B60L 11/005 180/302 |

* cited by examiner

*Primary Examiner* — Michael Leslie
(74) *Attorney, Agent, or Firm* — Robert Charles Hill

(57) ABSTRACT

A compressed air propulsion system supplies air utilized by a pair of opposing cylinders and their associated pistons and push/pull rods to cause a pair of sprockets to rotate clockwise in a controlled manner. The two pistons are acted upon by the cycling of various valves which introduces and/or vents compressed air as directed by a computer using a downloaded program through wireless interfaces. One of the two sprockets in turn, through additional sprockets/chain/axle devices, is utilized to supply drive torque to a vehicle transmission. The other axle which is connected to the remaining sprocket and through an additional chain/sprocket/axle device operates a direct current generator which produces electricity for charging a battery.

5 Claims, 9 Drawing Sheets

Fig. #1
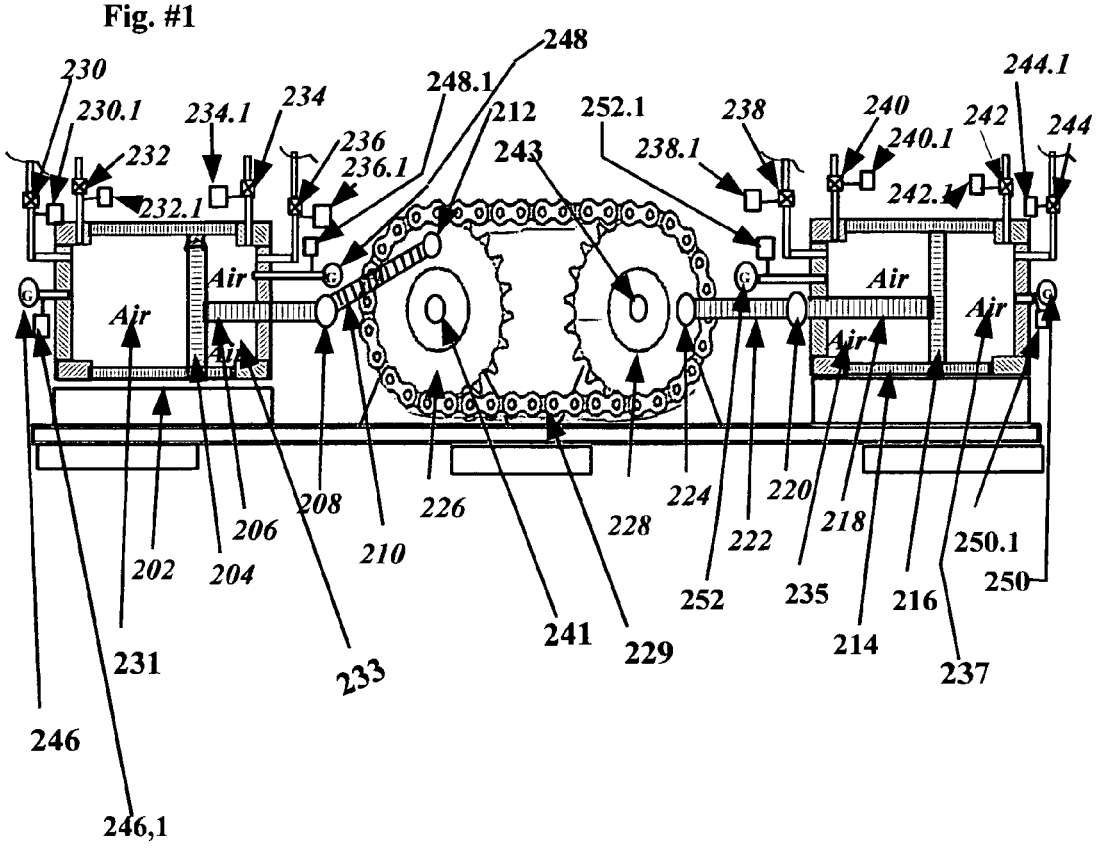

Fig #2
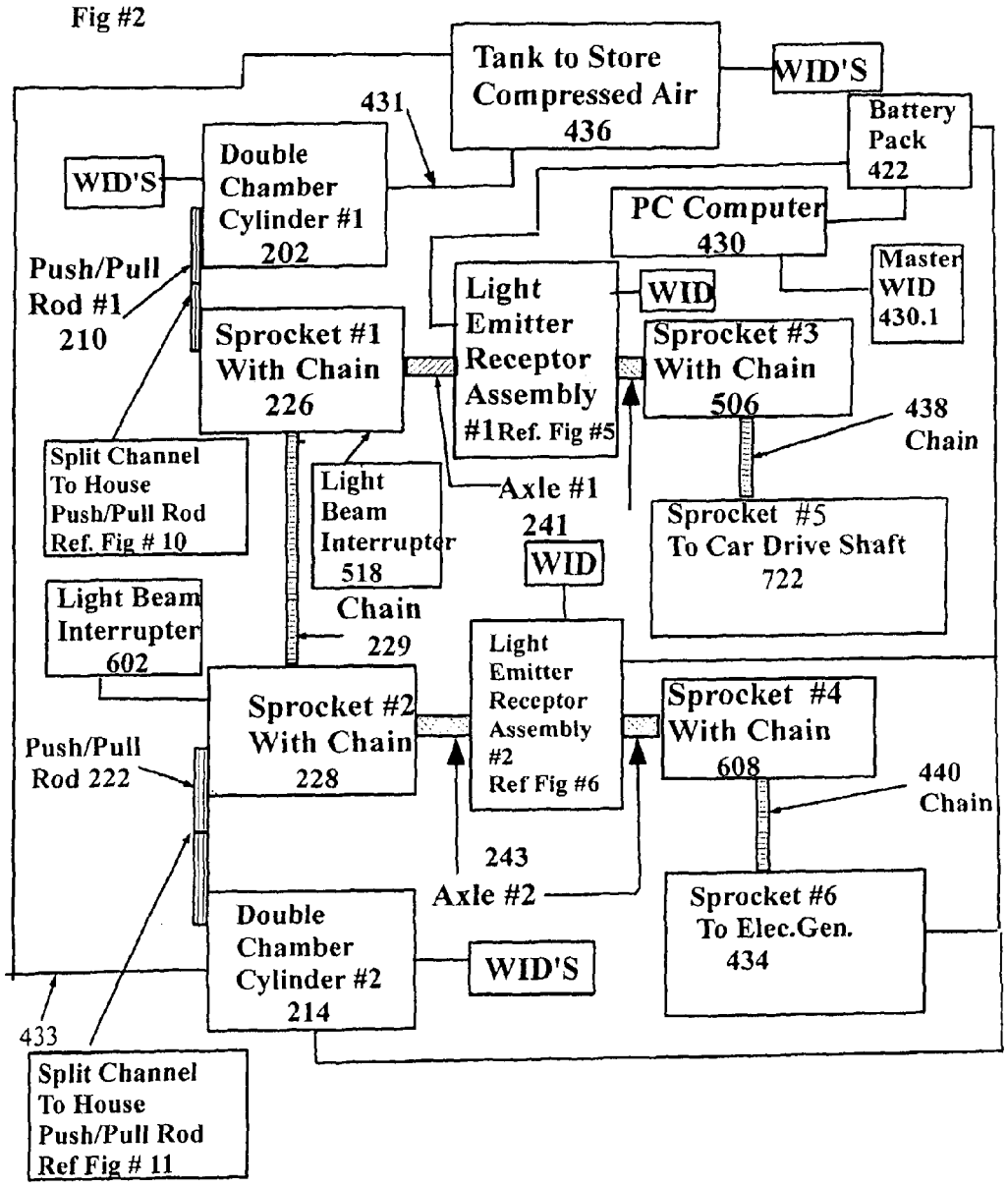

Fig. # 3
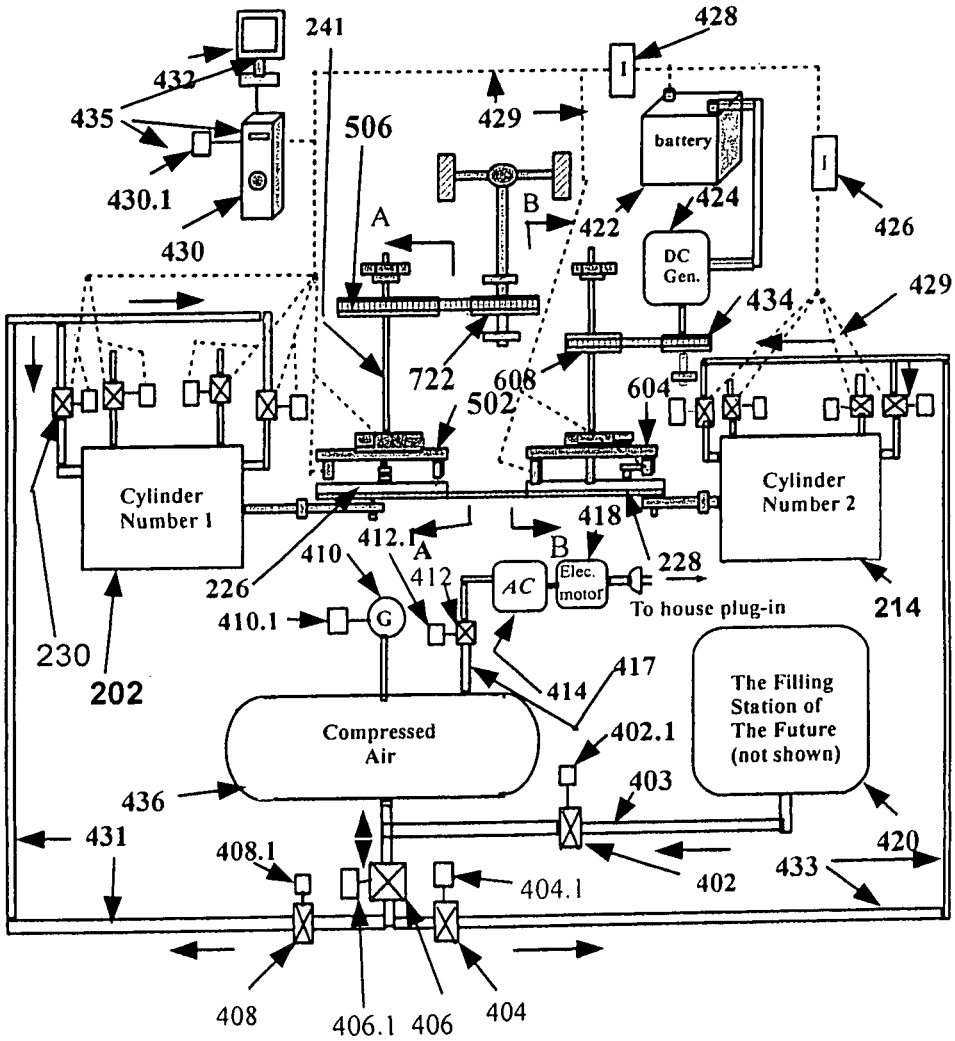

Fig. #4
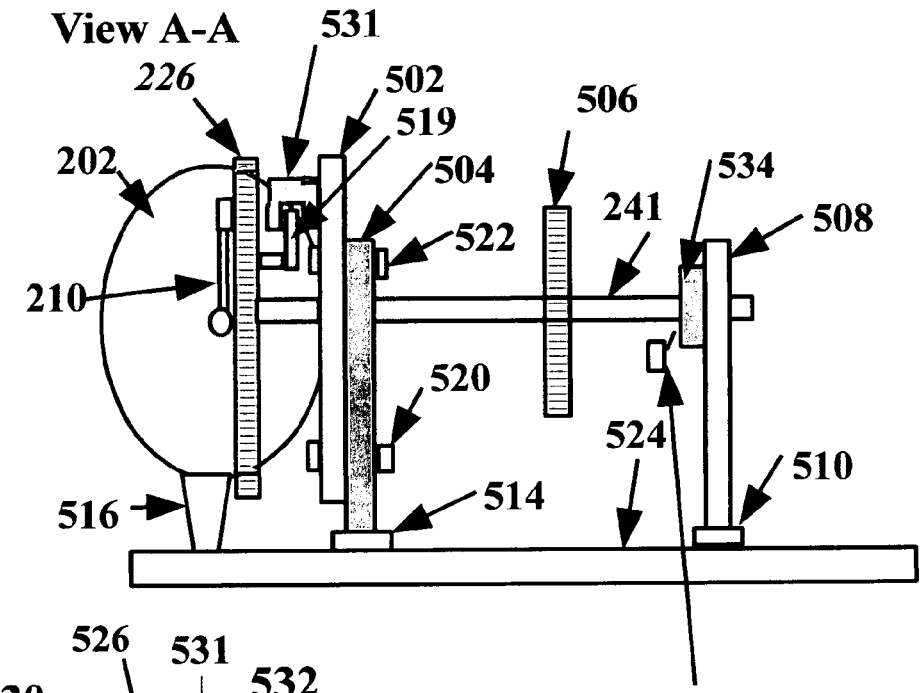
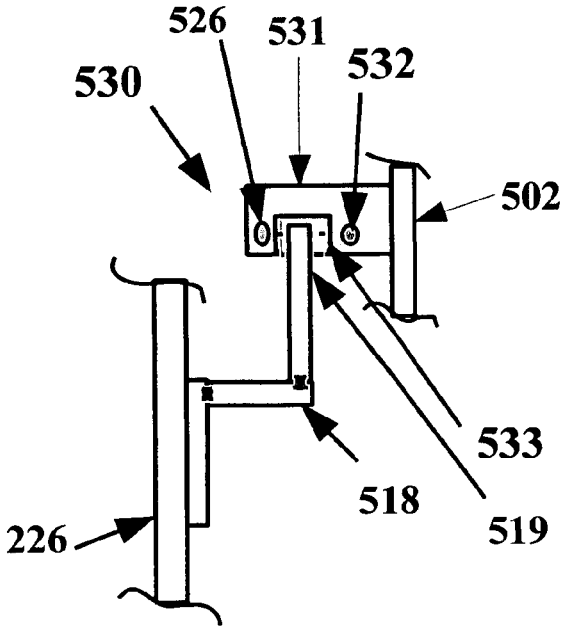

View B-B
Fig. #5
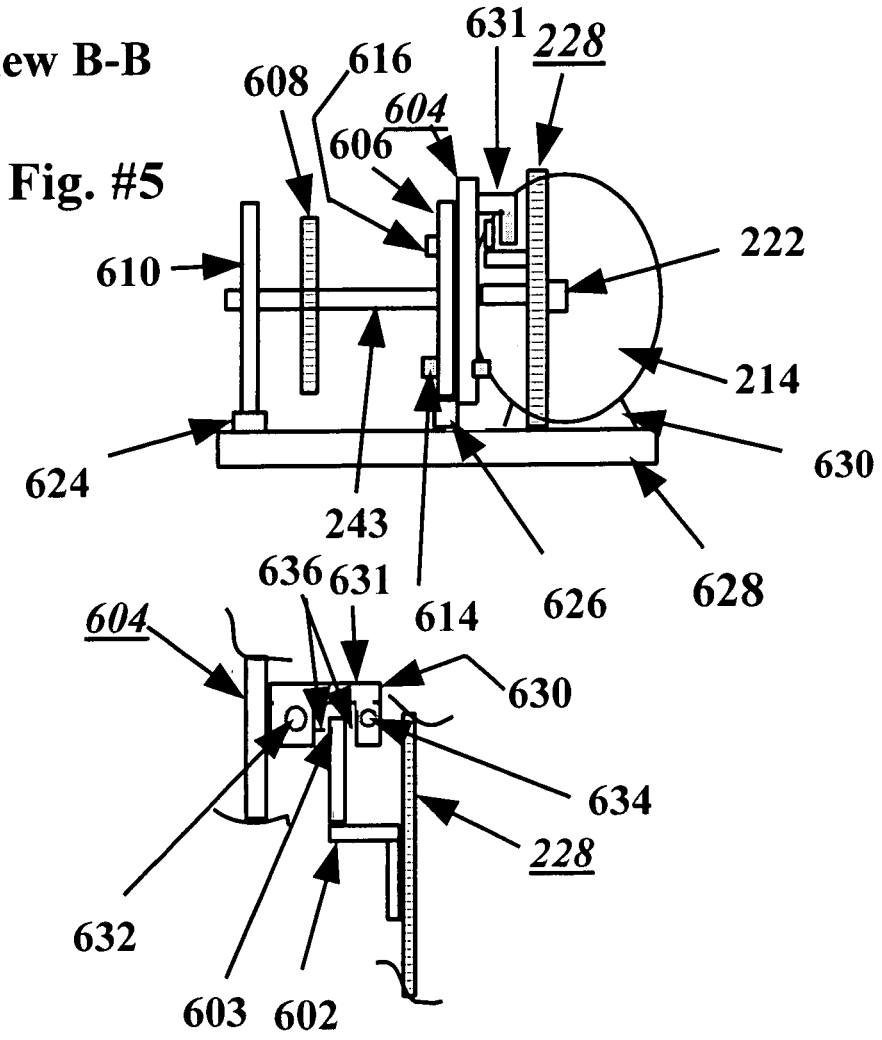

Fig. #6
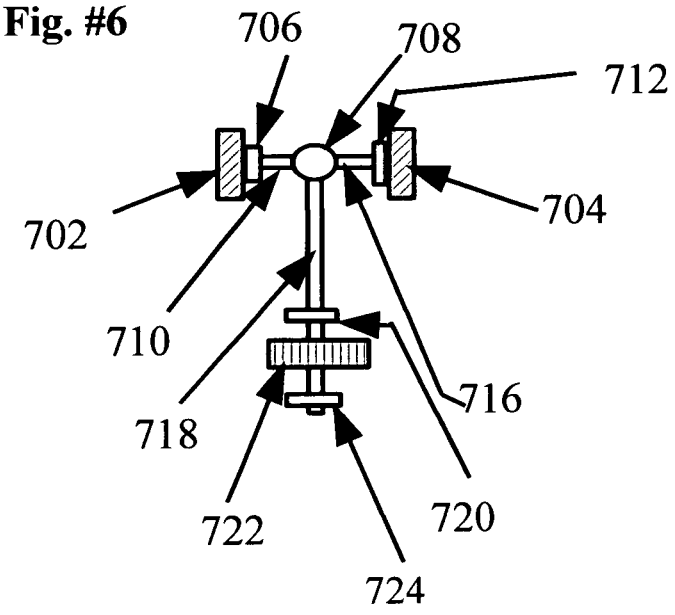

Fig. #7
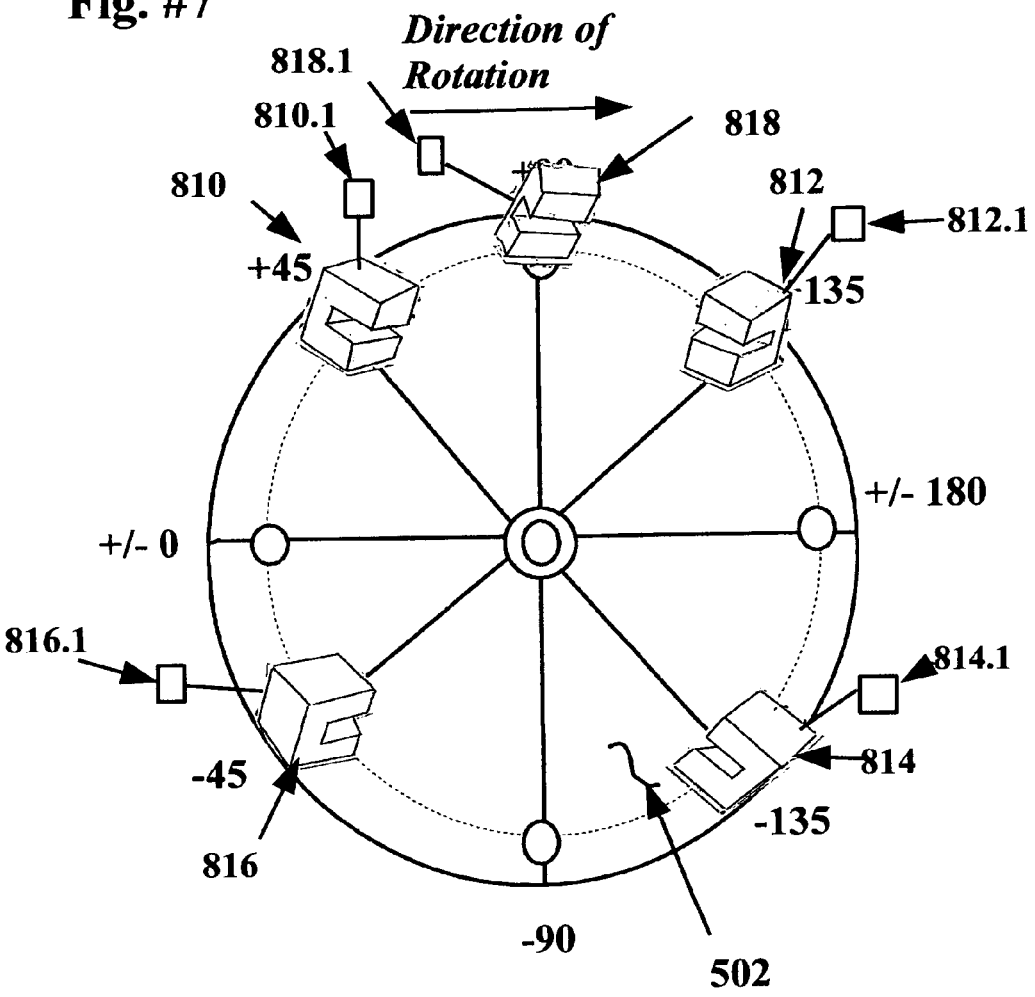

Fig #8
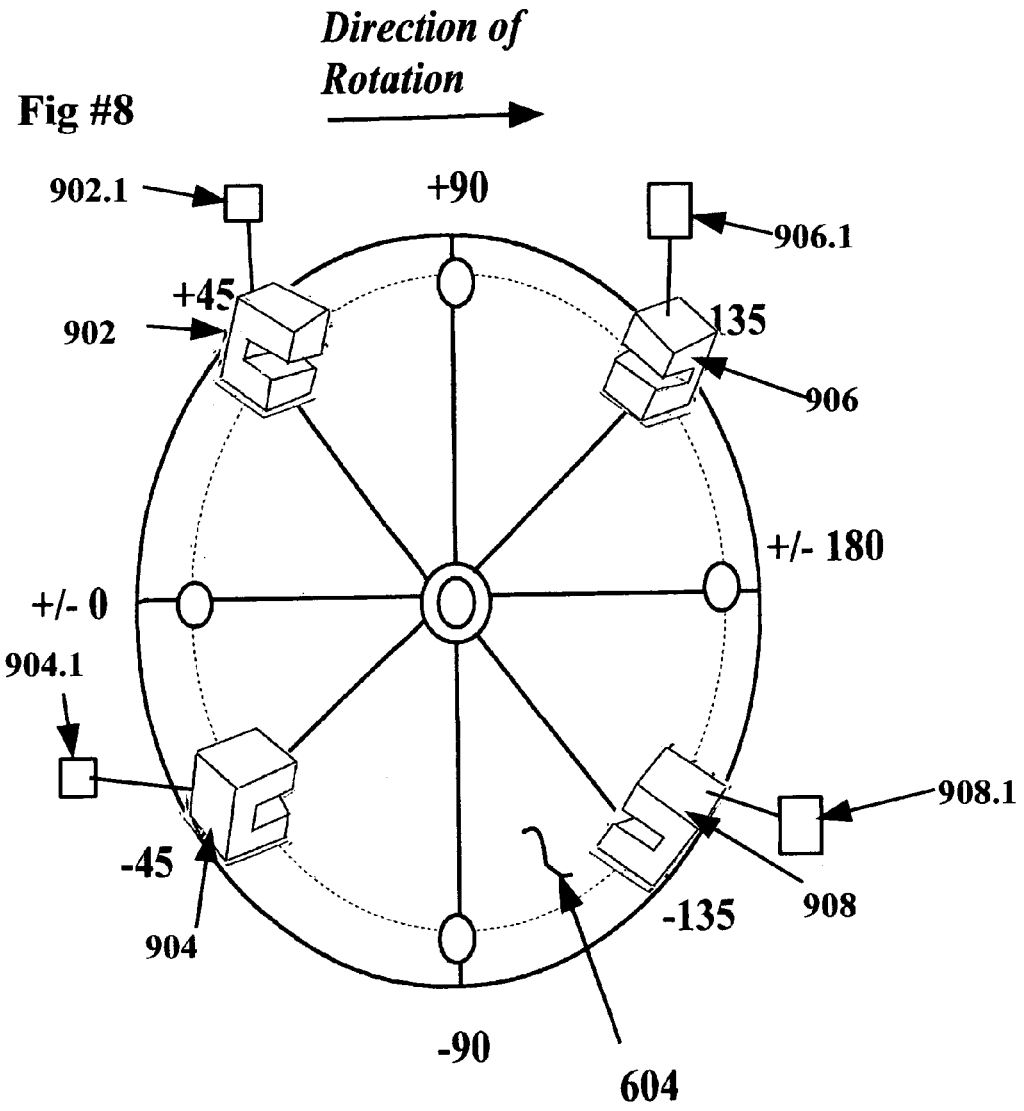

Fig #9

One Complete Operational Cycle

Step #1

| Cylinder 202 | Sprocket 226 | Sprocket 228 | Cylinder 214 |
|---|---|---|---|
| I/V 230 Open | Pivot Point 212 | Pivot Point 224 | I/V 238 Closed |
| V/V 232 Closed | Rotates from/to | Rotates from/to | V/V 240 Open |
| V/V 234 Open | +45 to +135 | +135 to -135 | V/V 242 Open |
| I/V 236 Closed | Refer to Fig's #1;#2 & #3 | | I/V 244 Closed |
| *Push Mode* | | | *Vent Mode* |

Step #2

| | | | |
|---|---|---|---|
| I/V 230 Closed | | | I/V 238 Closed |
| V/V 232 Open | Rotates from/to | Rotates from/to | V/V 240 open |
| V/V 234 Open | +135 to -135 | -135 to -45 | V/V 242 Closed |
| I/V 236 Closed | | | I/V 244 Open |
| *Vent Mode* | | | *Push Mode* |

Step #3

| | | | |
|---|---|---|---|
| I/V 230 Closed | | | I/V 238 Closed |
| V/V 232 Open | Rotates from/to | Rotates from/to | V/V 240 Open |
| V/V 234 Closed | -135 to -45 | -45 to+45 | V/V 242 Open |
| I/V 236 Open | | | I/V 244 Closed |
| *Pull Mode* | | | *Vent Mode* |

Step #4

| | | | |
|---|---|---|---|
| I/V 230 Closed | Rotates from/to | Rotates from/to | I/V 238 Open |
| V/V 232 Open | -45 to +45 | +45 to +135 | V/V 240 Closed |
| V/V 234 Open | | | V/V 242 Open |
| I/V 236 Closed | | | I/V 244 Closed |
| *Vent Mode* | | | *Pull Mode* |

Step #5

| | | | |
|---|---|---|---|
| I/V 230 Open | Pivot Point | Pivot Point | I/V 230 Closed |
| V/V 232 Closed | Rotates from/to | Rotates from/to | V/V 240 Open |
| V/V 234 Open | +45 to +135 | +135 to -135 | V/V 242 Open |
| I/V 236 Closed | | | I/V 244 Closed |
| *Push Mode* | | | *Vent Mode* |

This completes one complete Operational cycle for the invention

COMPRESSED AIR PROPULSION SYSTEM

CROSS-REFERENCE TO RELATED APPLICATIONS

This application is a Continuation-In-Part of U.S. Ser. No. 14/256,754 filed Apr. 18, 2014 for THE CAR OF THE FUTURE POWERED BY COMPRESSED AIR.

BACKGROUND OF THE INVENTION

1. Field of the Invention

The present invention relates to a propulsion system, and in particular to a propulsion system using compressed air in which supplies drive torque to a vehicle transmission as well as drive torque to an electronic generator for charging a battery.

2. Description of the Related Art

The proposed invention can be related to providing propulsion of a vehicle in a more efficient and less expensive manner, meanwhile reducing the amount of pollution being released into the atmosphere. The current method is not only wasteful and inefficient but is prone to producing vast amount of pollutants into the atmosphere on a daily basis while not doing useful work at the same time. This vast amount of pollution is believed to be contributing to the global warming of the earth and all of the ills that are attendant with it, like flooding of lower coastal regions etc. The basic reason, as concerns motor vehicles, is the ever increasing congestion on all of the nations roadways whether city streets; state highways or federal freeways. This massive congestion results in prolonged delay of vehicles of all types in trying to reach their destinations. The impressive gas mileages that all of the automobile manufacturing companies extol are meaningless when all of the vehicles during the rush hour spend long periods of time stalled and idling in traffic. Although the electric car is subject to the same traffic delays as all of the other vehicles propelled by a different method such as gas or diesel engine, still the electric car is in the off mode when not in motion. Yet the problem with the electric car and hybrid car, even though to a lesser degree, is the limited amount of storage of electricity available with the current technology in battery manufacturing.

BRIEF SUMMARY OF THE INVENTION

The compressed air propulsion system of the present invention includes a compressed air tank. First and second identical opposing cylinders have a piston connected to a piston rod. Each piston divides the cylinder into two chambers and each chamber is connected to inlet and outlet valves with the inlet valves connected to the compressed air tank. First and second sprockets joined by a common chain are mounted on corresponding first and second axles. The piston rods of the first and second cylinders are connected to corresponding first and second sprockets at a pivot point. Each axle has a fixed disc mounted adjacent to the sprocket. The fixed disc includes plural light beam emitter/receptor devices that send signals to an electronic control unit for controlling the opening and closing of the inlet and outlet valves based on the position of interrupters mounted to each sprocket. The first axle connected to the first sprocket supplies drive torque to a vehicle transmission and the second axle connected to the second sprocket supplies drive torque to an electronic generator which charges a battery.

BRIEF DESCRIPTION OF THE DRAWINGS

FIG. 1 is an end view of the present invention.

FIG. 2 is a block diagram of the present invention.

FIG. 3 is a top view of the present invention.

FIG. 4 is a view taken along line A-A of FIG. 3.

FIG. 5 is a view taken along line B-B of FIG. 3.

FIG. 6 is a top view of the drive shaft and its housing.

FIG. 7 shows five brackets affixed to fixed disc 502.

FIG. 8 shows 4 brackets affixed to fixed disc 604.

FIG. 9 is a listing that depicts all of the various modes of the two cylinders for one cycle of the sprockets.

DETAILED DESCRIPTION OF THE INVENTION

Many of the details of the present invention are shown in FIGS. 1 through 5 including a compressed air tank 436 (FIGS. 2 and 3). First 202 and second 214 identical opposing cylinders include a piston connected to a piston rod. First cylinder 202 has piston 204 connected to piston rod 206 while second cylinder 214 has piston 216 connected to piston rod 218.

Each piston is divided into two chambers. As shown in FIG. 1 first cylinder 202 has chambers 231 and 233 while second cylinder 214 has chambers 235 and 237.

Each chamber has inlet valves and outlet or vent valves. Left chamber 231 of first cylinder 202 is provided with inlet valve 230 and vent or outlet valve 232 and pressure gauge 246. Right chamber 233 of first cylinder 202 is provided with inlet valve 236 and vent or outlet valve 234 and pressure gauge 248. Likewise left chamber 235 of second cylinder 214 is provided with inlet valve 238 and vent or outlet valve 240 and pressure gauge 252. Right chamber 237 of second cylinder 214 is provided with inlet valve 244 and vent or outlet valve 242 and pressure gauge 250.

The cylinder chambers are connected to the compressed air tank 436 via inlet valves. As shown in FIG. 3 inlet line 431 connects tank 436 with first cylinder 202 via inlet valves 230 and 236 while inlet line 433 connects tank 436 with second cylinder 214 via inlet valves 238 and 244.

First sprocket 226 and second sprocket 228 are joined by common chain 229. First sprocket 226 is mounted on first axle 241 and second sprocket 228 is mounted on second axle 243.

The piston rods of the first and second cylinders are connected to a corresponding one of the first and second sprockets at a pivot point. As shown in FIG. 1, piston rod 206 of first cylinder 202 is connected to first sprocket 226 at pivot point 212 via joint 208 and push rod 210 while piston rod 218 is connected to second sprocket 228 at pivot point 224 via joint 220 and push rod 222. Since pivot 212 is at 90° and pivot point 224 is at +1-180° the pivot points are 90° out of phase.

Each axle has a fixed disc mounted adjacent to the sprocket. As shown in FIG. 4, first axle 241 has fixed disc 502 mounted adjacent to first sprocket 226. In FIG. 5 second axle 243 has a fixed disc 604 mounted adjacent to second sprocket 228.

Each fixed disc 502 and 604 includes plural light beam emitter/receptor devices 530 (FIG. 4) and 630 (FIG. 5) that send signals to an electronic control unit 435 for controlling the opening and closing of the inlet valves 230 236, 238, 244 and outlet valves 232, 234, 240, 242 based on the position of interrupts 518 and 602 mounted to each sprocket 226 and 228.

The first axle 241 is connected to the first sprocket 226 supplying drive torque to a vehicle transmission (FIG. 3); and the second axle 243 is connected to the second sprocket 228 supplying drive torque to an electronic generator (FIG. 3) which charges a battery.

As shown in FIG. 3 the electronic control unit 435 includes a computer 430, a master wireless interface device 430.1 and a monitor 432. Various wireless interface devices (WID) serve as the wireless link with the master wireless interface device 430.1 which enables the computer 430 to command the opening and closing of inlet and/or outlet valves in a preprogrammed order.

FIG. 1 shows first cylinder 202 having WID 230.1 associated with inlet valve 230, WID 232.1 associated with outlet valve 232, WID 234.1 associated with outlet valve 234, WID 236.1 associated with inlet valve 236, WID 246.1 associated pressure gauge 246, and WID 248.1 associated with pressure gauge 248. Likewise, second cylinder 214 had WID 238.1 associated with inlet valve 238, WID 240.1 associated with outlet valve 240, WID 242.1 associated with outlet valve 242, WID 244.1 associated with outlet valve 244, WID 250.1 associated with pressure gauge 250, and WID 252.1 associated with pressure gauge 252.

The master wireless interface device 430.1 is the link between the computer 430 and the various switches, pressure gauges and emitter/receptor devices.

The opening and closing of the various switches are dependent on which light beam has been intercepted or blocked by the light beam interrupter. For cylinder 202 that would be 518 from FIG. 4 and for cylinder 214 that would be light beam interrupter 602 of FIG. 5.

Each light beam that is blocked informs the computer to command a particular inlet valve to change to the open or closed mode or for a particular vent valve to change to the open or closed mode.

The changes by valves of both cylinders are made at the same time. The only difference is that each sprocket has its own light beam interrupter attached to the back of it. And since the two cylinders work together it is required that the particular valves open and close in conformance with instructions that have been programmed in the computer program that has been down loaded on the computer hard drive.

The device is intended to work when each piston produces power in sequence, not simultaneously. When one piston is in the push or pull power mode the other piston is in the vent mode.

As stated, the device operates in several modes. First is the start up mode in the clockwise direction, then operation mode. This can be of the push or pull mode by either of the pistons. There is also the shut down mode where the device is brought to a halt. These modes apply only to the two cylinders.

In FIG. 2 compressed air from tank 436 goes through inlet line 431 to first cylinder 202 to drive push rod 210 which rotates first sprocket 226 and downstream sprocket 506 on first axle 241. Then downstream sprocket 506 by means of chain 438 rotates connecting sprocket 722 which connects to a vehicle drive shaft. In the same manner compressed air from tank 436 goes through inlet line 433 to second cylinder 214 to drive push rod 222 which rotates second sprocket 228 and downstream socket 608 on second axle 243. Then downstream socket 608 by means of chain 440 rotates connecting sprocket 434 which connects to electric generator 424. The electric generator supplies power to battery pack 422.

FIG. 3 has another mode that involves the valves and pressure gauges that are involved in introducing air under high pressure into the various tanks from one or more external sources. One would be from a filling station of the future or from a compressor located in the owners garage.

Electric motor 418 operates air compressor 414 which supplies compressed air via line 417 to tank 436 through valve 412. Also, station 420 supplies compressed air via line 403 to tank 436 through valve 402 when valve 406 is closed. Pressure within tank 436 should be around 600 psi while the pressure within cylinders 202 and 214 as regulated by the various pressure gauges is between 10-15 psi.

FIG. 3 also shows connecting sprocket 434 rotating generator axle to supply electricity to DC generator 424 which goes into battery 422 via line 423. DC from the battery 422 goes through inverters 426 and 428 to become AC which then goes through electric lines 429 to supply power to all valves, WIDS, pressure gauges and other equipment that require electricity.

The lower portion of FIG. 4 is a larger view of the emitter/receptor assembly, generally indicated 530, which has a light beam interrupter 518 attached to the back side of first sprocket 226 and bracket 531 attached to fixed disc 502. Bracket 531 houses light beam emitter 526 and light beam receptor 532 having light beam 533 therebetween. As sprocket 226 is rotated finger 519 of light beam interrupter 518 breaks the light beam 533 between emitter 526 and receptor 532, the consequences of which will be described later.

Supports 504 and 508 on base 524 house first axle 241 which is connected to first sprocket 226 and downstream sprocket 506. Flange 514 attaches to support 504 and flange 510 attaches to support 508. Fixed disc 502 is connected to support 504 by bolts 520 and 522. Brake 534 is on axle 241 and is activated by WID 534.1.

The lower portion of FIG. 5 is a larger view of the emitter/receptor assembly, generally indicated 630, which has a light beam interrupter 602 attached to the back side of second sprocket 228 and a bracket 631 attached to fixed disc 604. Bracket 631 houses light beam emitter 632 and light beam receptor 634 having light beam 636 therebetween. As sprocket 228 is rotated finger 603 of light beam interrupter 602 breaks the light beam 636 between emitter 632 and receptor 634, the consequences of which will be described later.

Supports 606 and 610 on base 628 house second axle 243 which is connected to second sprocket 228 and downstream sprocket 608. Flange 626 attaches to support 606 and flange 624 attaches to support 610. Fixed disc 604 is connected to support 606 by bolts 614 and 616.

FIG. 6 is an enlarged view of a portion of FIG. 3 wherein supports 720 and 724 hold housing/drive shaft 718 which engages differential 708. Rotation of sprocket 722 rotates drive shaft 718 which through differential 708 rotates left axle 710 and right axle 716 thereby rotating wheels 702 and 704. Brake 706 is adjacent wheel 702 while brake 712 is adjacent wheel 704.

FIG. 7 shows brackets 810, 812, 814 and 816 attached to fixed disc 502 at angles of +45, +135, −135, and −45 respectfully. Bracket 818 at +90 is de-energized in operational mode and is activated during the shut down mode. As described above for FIG. 4 each bracket houses a light beam emitter and a light beam receptor having a light beam therebetween. WIDs 810.1, 812.1, 814.1, 816.1, and 818.1 are associated with their respective brackets.

FIG. 8 shows the four brackets on fixed disc 604. Bracket 902 is attached at +45°, bracket 904 at 45°, bracket 906 at +135°, and bracket 908 at −135°. WIDs 902.1, 904.1, 906.1 and 908.1 are associated with their respective brackets. As described above for FIG. 5 each bracket houses a light beam emitter and a light beam receptor having a light beam therebetween.

FIG. 9 lists the open and closed positions of the inlet and vent valves as the sprockets 226 and 228 complete one operational cycle. This will be explained in detail later on.

The invention has two power units consisting of two cylinders that are in opposition. Each cylinder has an enclosed piston which divides the cylinder into two chambers. Each chamber of each cylinder is furnished with an inlet valve and an outlet or vent valve.

Each inlet valve allows air under pressure from the internal storage tank(s) to flow into the particular chamber in conformance with instructions previously included in a computer program downloaded on the computer hard drive. This pressured air in turn applies force to a piston. Each piston is connected to a push/pull bar that moves right or left with the piston. Each horizontal push/pull bar in turn is connected to a second push/pull bar that pivots at the connection point with its respective horizontal push/pull bar.

Functioning of the individual vent valves is identical to that of any inlet valves. Commands to change from the open or closed mode are transmitted wirelessly through commands from the electronic control unit through electronic pulses.

Any one of the four individual pressure gauges serves only to provide a constant readout to the computer wirelessly of the pressure existing in a particular chamber at a particular moment in time. Pressure gauges play no active role in generating force by the power unit.

The two sprockets rotate in unison due to a common chain that links them together. Each of the two sprockets is identical in size and shape and functions the same way.

Operation of the inlet valves or vent valves in either the open or closed position is determined by instructions from and through the master wireless interface device 430.1 to the individual wireless interface devices that are part of each of the inlet or vent valve assemblies.

The compressed air propulsion system operates in one of three modes. These modes are startup, operation, and shutdown.

Each of the two cylinders operates in one of four modes. The modes are push, vent, pull and vent. These modes are repetitive. When either cylinder is in the push or pull mode the opposite cylinder is in the vent mode.

Only one inlet valve of the four inlet valves on the cylinders can be in the open position mode at any time during the operation mode. More than one vent valve in either cylinder may be in the open mode at any one time.

Startup Mode

When the system is placed in the startup mode on computer command inlet valve 230 is ordered to the open mode. Pivot point 212 rotates between locations +90 and +135 relative to fixed disk 502. This causes finger 519 of light beam interrupter 518 attached to the back side of sprocket 226 to break light beam 533 housed within bracket 812 at location +135 of fixed disk 502 resulting in inlet valve 230 changing from the open mode to the closed mode.

Pivot point 224 has been resting at location +180 relative to fixed disk 604 during the shutdown mode. Pivot point 224 rotates from +180 to location −135. This causes finger 603 of light beam interrupter 602 attached to the back side of sprocket 228 to break the light beam 636 housed within bracket 908 of fixed disk 604 causing inlet valve 244 to change from the off mode to the on mode. Meanwhile vent valve 242 changes from the on mode to the off.

The power unit of the invention continues to operate on commands transmitted by wireless pulses to the various valves and switches until the next shutdown operation is reached.

Operation Mode

For cylinder 202 the push mode occurs when inlet valve 230 is in the open mode, vent valve 232 is in the closed mode and inlet valve 236 is in the closed mode while vent valve 234 is in the open mode. At the same time inlet valve 244 of cylinder 214 is in the closed mode and vent valve 242 in the right chamber of cylinder 214 is in the open mode. Inlet valve 238 is in the closed mode while vent 240 is in the open mode. Air flows into the left chamber of cylinder 202 and out through vent valve 234 of the right chamber. During the same interval in time air flows in or out of either vent valve 240 or 242 as the two sprockets rotate.

Cylinder 202 is in either of the two vent modes when both inlet valves 230 and 236 are in the closed mode and the two vent valves 232 and 234 are in the open mode. During the same interval in time inlet valves 238 and 244 of cylinder 214 are in the closed mode. Conversely vent valves 240 and 242 are in the open mode. Air may flow in or out of either chamber depending on the direction the particular piston is moving.

Cylinder 202 is in the pull mode when pressure enters chamber 233 through inlet valve 236 which is in the open mode and vent valve 234 located in the same chamber is in the closed mode. Inlet valve 230 is in the closed mode and vent valve 232 is in the open mode. For cylinder 214 both inlet valves 238 and 244 are in the closed mode and vent valves 240 and 242 are in the fully open mode.

Cylinder 214 is in the push mode when inlet valve 244 is in the open mode, vent valve 242 is in the closed mode, inlet valve 238 is in the closed mode and vent valve 240 is in the open mode. At the same time both inlet valves 230 and 236 of cylinder 202 are in the closed mode while both vent valves 232 and 234 are in the fully open mode.

Cylinder 214 is in either of the two vent modes when inlet valves 238 and 244 are in the closed mode and vent valves 240 and 242 are in the fully open mode. Cylinder 202 is in the either the push mode or the pull mode.

Cylinder 214 is in the pull mode when inlet valve 238 is in the open mode, vent valve 240 is in the closed mode, inlet valve 244 is in the closed mode and vent 242 is in the open mode.

As shown in FIG. 9, cylinder 202 is also in the push mode when pivot point 212 rotates between +45 and +135 relative to fixed disk 502 (FIG. 3 & FIG. 7) and in the vent mode when pivot point 212 rotates between +135 and −135. It is in the pull mode when pivot point 212 rotates between −135 and −45. It is in a second vent mode when pivot point 212 rotates between −45 and +45. Any following rotation repeats itself. The rotation of either sprocket depends on direction of rotation of either push/pull bar depending on which is in the power mode.

Cylinder 214 is in the push mode when pivot point 224 rotates between −135 and −45 of fixed disk 502. It is in one of two vent modes when pivot point 224 rotates between −45 and +45. It is in the pull mode when pivot point 224 rotates between +45 and +135. It is in a second vent mode when pivot point 224 rotates between +135 and −135.

Opening or closing of any of the four inlet valves of the two cylinders or the vent valves thereof depends on pulses transmitted through wireless interfaces devices (WIDs). The pulses generated by the master wireless interface device 430.1 are determined by instructions embedded in the computer program. These pulses are transmitted in a predetermined order to achieve a smooth rotation of the two sprockets. Rotation of the sprockets in turn causes the axles they are mounted on to rotate. One axle 241 serves to provide motion for a vehicle while rotation of a second axle provides rotation of the armature of the DC generator to generate electricity to power the invention.

In operation starting with cylinder 202 in the push mode with inlet valve 230 in the open mode, vent valve 232 in the closed mode, vent valve 234 in the open mode while inlet valve 236 is in the closed mode. In the same interval of time both inlet valve 238 and 244 of cylinder 214 are in the closed mode and vent valves 240 and 242 are in the open mode. Air under pressure is introduced through inlet valve 230 and flows out of right chamber vent valve 234. Air that is in the chambers 235 and 237 flows in or out of either chamber depending on the motion of piston 216.

Each sprocket has a light beam interrupter device (LBI) mounted on the reverse side of the sprocket. Sprocket 226 has LBI 518 (refer to FIG. 4) mounted along a radius extending from the center of axle 241 (refer to FIG. 1) vertically to a position opposite to pivot point 212. LBI 602 (refer to FIG. 5) is mounted along a radius extending from the center of axle 243 (refer to FIG. 1) to a point opposite to pivot point 224).

The finger 519 of LBI 518 breaks in succession the light beams 533 housed in brackets 818, 812, 814 and 816 (refer to FIG. 4 & FIG. 7).

Meanwhile the finger 603 of LBI 602 breaks successively through the light beams 636 housed in brackets 902, 906, 908 and 904 (refer to FIG. 5 & FIG. 8).

For the emitter/receptor assembly 530 mounted on the face of fixed disc 502 (refer to FIG. 3) pulses are generated when the finger 519 of LBI 518 momentarily breaks the light beam existing between the particular emitter/receiver device gap. This also occurs simultaneously when the finger 603 of LBI 602 momentarily breaks the light beam existing between the particular emitter/receptor devices that are mounted on the face of fixed disk 604.

The emitter/receptor housed in bracket 818 is provided with electrical power only during the shutdown mode but is not active in the startup or operational mode.

Blockage of the light beam within bracket 810 at location +45 on fixed disk 502 causes the computer through the master wireless interface device 430.1 to transmit a pulse or pulses that cause inlet valve 230 to change from the closed mode to the open mode. Another pulse generated at the same time causes vent valve 232 to change from the open mode to the closed mode as cylinder 202 changes from the vent mode to the push mode. Other pulses when LBI 602 breaks the light beam at −45 on fixed disk 604 (refer to FIG. 8) causing inlet valve 244 to change from the open mode to the closed mode and another pulse causes vent valve 242 to change from the closed mode to the open mode as cylinder 214 changes from the push mode to the vent mode.

Blockage of the particular light beam of any of the emitter/receptor devices in like manner causes inlet and outlet valves of both cylinders to command the particular inlet or vent valves to open or close as cylinders change from one mode to the next mode.

Shutdown Mode

When the shutdown activating device (not shown) is in the on mode and on the second rotation of pivot point 212 through location +45 of fixed disk 502 inlet valve 230 is changed to the open condition until pressure gauge 246 by pulse verifies that the design pressure of 10 psi in chamber 231 has been reached. At this time inlet valve 230 is placed in the closed mode. This is imposed on inlet valve 230 so that the pressure in chamber 231 decreases as sprocket 226 continues to rotate and chamber 231 increase in volume causing a decrease in pressure. This preprogrammed decrease in pressure results in a decrease in the force exerted on the face of piston 204. When LBI 518 breaks the light beam E/R/D within 818 the electric current to E/R/D within 818 is placed in the off mode. At the same instant brake 534 mounted on axle 241 is placed in the engaged mode and the rotation of axle 241 is brought to a halt. In the shutdown mode both cylinders rest in the vent mode where inlet valves 230 and 236 of cylinder 202 rest in the closed mode and vent valves 232 and 234 rest in the open mode. Inlet valves 238 and 244 of cylinder 214 rest in the closed mode while vent valves 240 and 242 rest in the open mode.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A compressed air propulsion system, comprising:

a compressed air tank;

first and second identical opposing cylinders each including a piston connected to a piston rod, each piston dividing the cylinder into two chambers;

each chamber connected to inlet valves and outlet valves;

the cylinder chambers connected to the compressed air tank via the inlet valves;

first and second sprockets joined by a common chain, the sprockets mounted on corresponding first and second axles;

the piston rods of the first and second cylinders are connected to a corresponding one of the first and second sprockets at a pivot points;

each axle having a fixed disc mounted adjacent to the sprocket, wherein the fixed disc includes plural light beam emitter/receptor devices that send signals to an electronic control unit for controlling the opening and closing of the inlet valves and outlet vales based on the position of interrupters mounted to each sprocket;

the first axle connected to the first sprocket supplying drive torque to a vehicle transmission; and the second axle connected to the second sprocket supplying drive torque to an electronic generator which charges a battery.

2. The compressed air propulsion system of claim 1 wherein:

each cylinder has 2 inlet valves, 2 outlet valves, and a pressure gauge.

3. The compressed air propulsion system of claim 1 wherein:

each emitter/receptor device has a light beam interrupter attached to the back side of a sprocket.

4. The compressed air propulsion system of claim 3 wherein:

a bracket attached to a fixed disc which houses a light beam emitter, and a light beam receptor having a light beam therebetween.

5. The compressed air propulsion system of claim 4 wherein:

rotation of the sprocket causes a finger on the light beam interrupter to break the light beam between the light beam emitter and the light beam receptor.

* * * * *